United States Patent [19]

Thomas

[11] Patent Number: 4,895,080

[45] Date of Patent: Jan. 23, 1990

[54] INTERLOCKING FREIGHT PALLET

[76] Inventor: Peter C. Thomas, 6750 Riverside Boulevard, Sacramento, Calif. 95831

[21] Appl. No.: 308,673

[22] Filed: Feb. 10, 1989

[51] Int. Cl.[4] ..... B65D 19/12

[52] U.S. Cl. ..... 108/56.1; 52/589

[58] Field of Search ..... 108/56.1; 52/589

[56] References Cited

U.S. PATENT DOCUMENTS

| | | | |
|---|---|---|---|
| 3,380,403 | 4/1968 | Sullivan | 108/901 X |
| 3,650,224 | 3/1972 | Petix et al. | 108/56.1 |
| 3,650,225 | 3/1972 | Ball . | |
| 3,651,769 | 3/1972 | Foley | 108/56.1 |
| 3,654,874 | 4/1972 | Skinner | 108/56.1 X |
| 3,720,027 | 3/1973 | Christensen | 52/589 X |
| 4,062,301 | 12/1977 | Pitchford | 108/56.1 |
| 4,095,769 | 6/1978 | Fengels . | |
| 4,258,522 | 3/1981 | Amaral | 52/589 X |
| 4,348,442 | 9/1982 | Figge | 108/56.1 X |
| 4,566,235 | 1/1986 | Groll | 52/589 |

*Primary Examiner*—Peter A. Aschenbrenner
*Attorney, Agent, or Firm*—Jerry T. Kearns

[57] ABSTRACT

A freight pallet may be formed in a wide variety of user determined configurations by assembly of a plurality of interlocking construction units. Each of the units has a square thin support plate with a projecting rib extending along a first pair of adjacent perpendicular side edges. A complementary formed groove extends along a second pair of adjacent perpendicular side edges of the support plate. A right angle corner support member is perpendicularly attached at each corner on a bottom surface of the support plate. Each pair of adjacent corner support members are connected by a support brace. The construction units may be assembled adhesively or through thermoplastic bonding by forming portions of the projecting ribs and complementary grooves from a thermosetting plastic material.

7 Claims, 4 Drawing Sheets

INTERLOCKING FREIGHT PALLET

BACKGROUND OF THE INVENTION

1. Field of the Invention

The present invention relates to freight pallets, and more particularly pertains to a new and improved freight pallet formed from a plurality of identical interlocking construction units. The standard industry freight pallet is formed from a plurality of wooden boards which are nailed together to form a four foot by four foot pallet. While inexpensive, these pallets are not exceedingly strong or durable. Additionally, many industrial users require specific pallet configurations for packing and transporting irregularly configured products. The conventional forms of pallets are not easily altered to meet these requirements. In order to overcome these problems, the present invention provides a freight pallet formed from a plurality of molded plastic construction units which may be assembled in a wide variety of configurations to meet the specific requirements of an individual user.

2. Description of the Prior Art

Various types of freight pallets are known in the prior art. A typical example of such a freight pallet is to be found in U.S. Pat. No. 3,650,225, which issued to B. Ball on Mar. 21, 1972. This patent discloses a pallet constructed from a plurality of blocked units non-rotatably connected together to form a rigid pallet platform surface. U.S. Pat. No. 3,651,769, which issued to L. Foley on Mar. 28, 1972, discloses a set of pallet-forming members which may be assembled to form a wide variety of pallet sizes and configurations. The pallet construction members are elongated and provided with a plurality of apertures adapted to be disposed in alignment and secured by connecting pin members. U.S. Pat. No. 4,095,769, which issued to G. Fengels on June 20, 1978, discloses a freight pallet including a core sandwiched between a pair of cover plates with the edges of the core enclosed by a shoulder strip extending around the periphery of the core and extending between the cover plates and forming at least four edges of the pallet. A plurality of openings are formed through the pallet edges communicating with an internal connecting member within the core. A plurality of connecting members are provided, and are removably insertable into the shoulder strip openings for joining a pair of pallets together.

While the above mentioned devices are suited for their intended usage, none of these devices disclose a pallet formed from a plurality of identical interlocking construction units, each including a square thin support plate having a projecting rib extending along each of a first pair of adjacent perpendicular side edges and a complementary formed groove extending along each of a second pair of adjacent perpendicular side edges. Additional features of the present invention, not disclosed by the aforesaid prior art devices include the use of mating trapezoidal projecting ribs and complementary grooves extending along opposite side edges of a pallet construction unit and adapted for adhesive securement or thermoplastic bonding with an adjacent unit. Inasmuch as the art is relatively crowded with respect to these various types of freight pallets, it can be appreciated that there is a continuing need for and interest in improvements to such freight pallets, and in this respect, the present invention addresses this need and interest.

SUMMARY OF THE INVENTION

In view of the foregoing disadvantages inherent in the known types of freight pallets now present in the prior art, the present invention provides an improved interlocking freight pallet. As such, the general purpose of the present invention, which will be described subsequently in greater detail, is to provide a new and improved interlocking freight pallet which has all the advantages of the prior art freight pallets and none of the disadvantages.

To attain this, representative embodiments of the concepts of the present invention are illustrated in the drawings and make use of a freight pallet which may be formed in a wide variety of user determine configurations by assembly of a plurality of interlocking construction units. Each of the units has a square thin support plate with a projecting rib extending along a first pair of adjacent perpendicular side edges. A complementary formed groove extends along a second pair of adjacent perpendicular side edges of the support plate. A right angle corner support member is perpendicularly attached at each corner on a bottom surface of the support plate. Each pair of adjacent corner support members are connected by a support brace. The construction units may be assembled adhesively or through thermoplastic bonding by forming portions of the projecting ribs and complementary grooves from a thermosetting plastic material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved interlocking freight pallet which has all the advantages of the prior art freight pallets and none of the disadvantages.

It is another object of the present invention to provide a new and improved interlocking freight pallet which may be easily and efficiently manufactured and marketed.

It is a further object of the present invention to provide a new and improved interlocking freight pallet which is of a durable and reliable construction.

An even further object of the present invention is to provide a new and improved interlocking freight pallet which is susceptible of a low cost of manufacture with regard to both materials and labor, and which accordingly is then susceptible of low prices of sale to the consuming public, thereby making such freight pallets economically available to the buying public.

Still yet another object of the present invention is to provide a new and improved interlocking freight pallet which provides in the apparatuses and methods of the prior art some of the advantages thereof, while simultaneously overcoming some of the disadvantages normally associated therewith.

Still another object of the present invention is to provide a new and improved interlocking freight pallet formed from a plurality of identical units which may be assembled in a wide variety of different configurations to suit the needs of a particular user.

Yet another object of the present invention is to provide a new and improved interlocking freight pallet which utilizes a plurality of identical, light weight, durable and reusable interlocking construction units.

Even still another object of the present invention is to provide a new and improved interlocking freight pallet which may be quickly and easily assembled into a wide variety of various different configurations by an individual user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
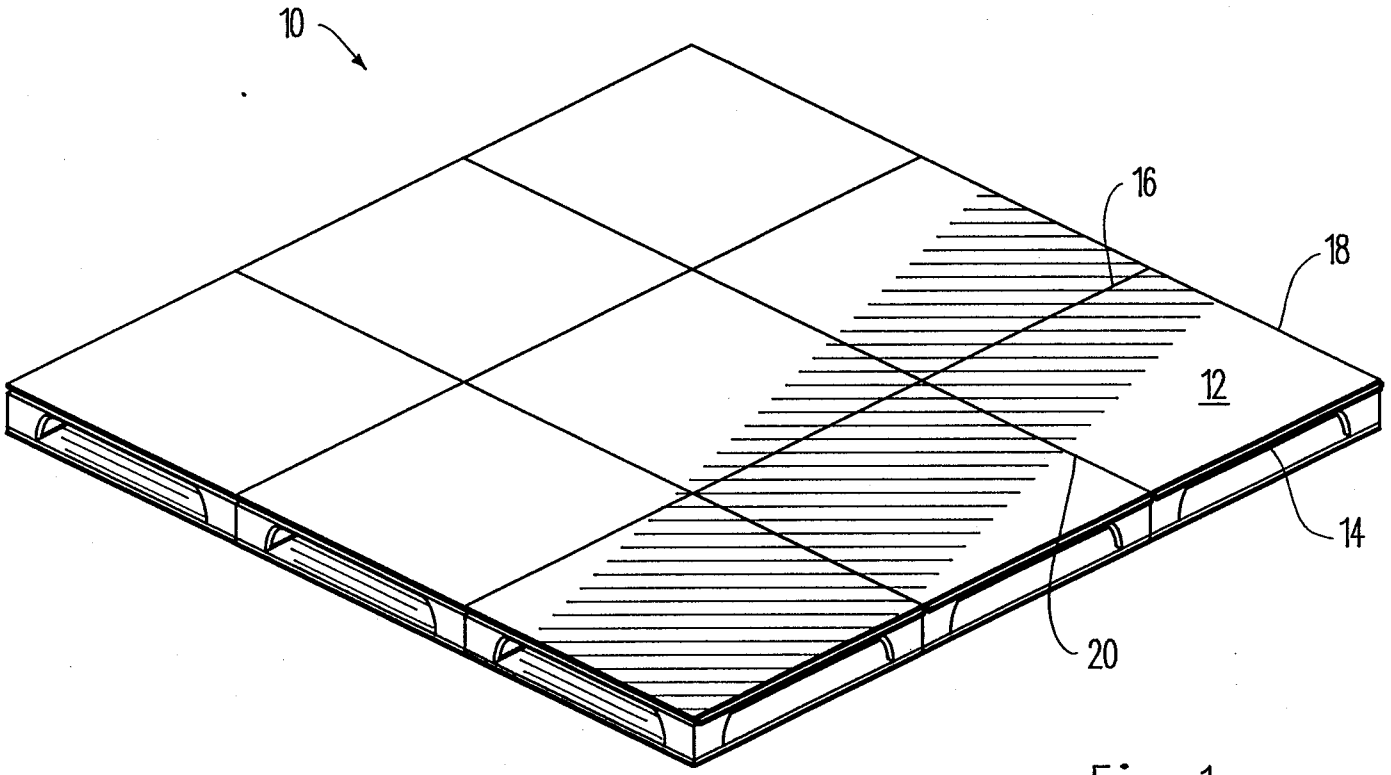
FIG. 1 is a perspective view of an assembled pallet formed from a plurality of interlocking individual construction units.

With reference now to the drawings, and in particular to FIG. 1 thereof, a new and improved interlocking freight pallet embodying the principles and concepts of the present invention and generally designated by the reference numeral 10 will be described.

More specifically, it will be noted that the first embodiment 10 of the invention includes a plurality of individual construction units 12, each having side edges 14, 16, 18 and 20. While the illustrated configuration consists of a three by three square assembly of nine interlocking units 12, it should be understood that any desired custom configuration may be formed, depending upon the needs of the individual user. For example, L, H, U, or T-shaped configurations may be formed by the assembly of the units 12. Preferred dimensions for the length and width of the units 12 are a twelve inch by twelve inch square or a sixteen inch by sixteen inch square. The use of twelve inch by twelve inch units allows a standard industrial four foot by four foot freight pallet to be formed by the assembly of sixteen individual construction units 12. The individual construction units 12 may be formed of any desired dimensions without departing from the scope of the present invention. The various component parts of the construction units 12 are preferably formed from a molded plastic material, provided with suitable conventional fiber reinforcements.

Figure 2:
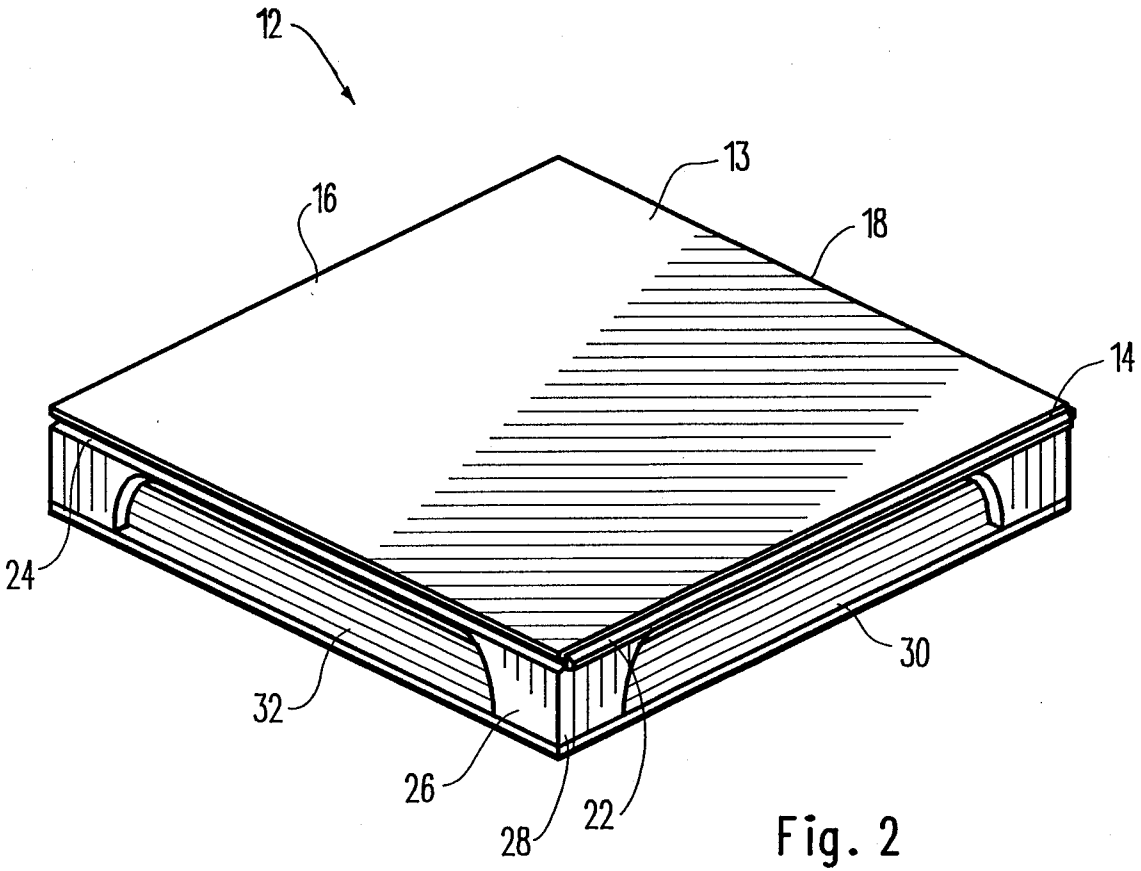
FIG. 2 is a perspective view illustrating the configuration of an individual construction unit.

FIG. 2 illustrates a single individual construction unit 12 which includes a square thin flat support plate 13 having four side edges 14, 16, 18 and 20. A first pair of adjacent, perpendicular side edges 18 and 20 are each provided with a projecting rib 22 extending therealong. The remaining pair of adjacent side edges 16 and 20 are provided with a complementary formed groove 24. In use, the individual construction units 12 is assembled with the required number of additional identical construction units 12 by interlocking engagement of the ribs 22 within a complementary formed groove 24 on an adjacent construction unit 12. The individual construction units 12 may be permanently secured together through the use of conventional adhesives, thermosetting adhesives, or the ribs 14 and grooves 24, or portions of either, may be formed from a thermoplastic material having a lower fusing point than the melting point of the plastic material utilized to form the remaining portions of the construction unit 12. This allows a number of construction units 12 to be assembled in a desired configuration and permanently fused together by heating the assembled unit to a temperature sufficient to fuse the thermo setting plastic ribs 14 within the complementary grooves 24. This assembly method may be carried into practice through the use of conventional heating devices and assembly fixtures. Alternatively, conventional adhesives may be applied along the ribs 14 and grooves 24 prior to assembly. Each individual construction unit 12 includes a plurality of right angle corner support units having perpendicular side faces 26 and 28. Each of the corner support members is perpendicularly attached at a corner on the bottom surface of the support plate 13. Each adjacent pair of corner support members is connected by a support brace member 30 or 32. The support brace members 30 and 32 form elongated rectangular plate members which extend along each side of the construction unit. These support braces prevent lateral deformation of the corner support member 26, 28 under load. A recess is formed between each pair of corner support members 26, 28 which communicates with the hollow interior of the construction unit 12. The recessed openings allow the insertion of the tines of a conventional fork lift truck.

Figure 3:
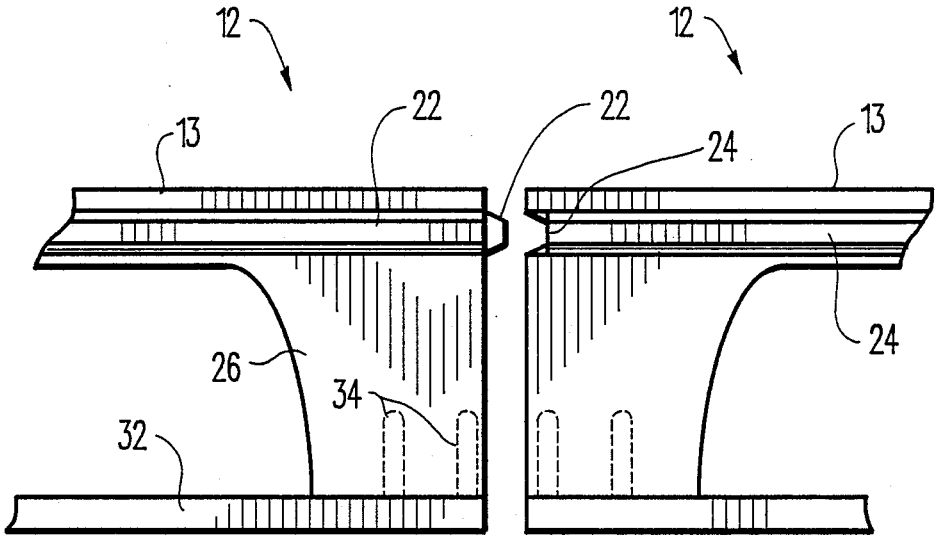
FIG. 3 is a side view illustrating the manner of assembly of two interlocking construction units.

As best seen in FIG. 3, the projecting ribs 22 of each individual construction unit 12 are preferably formed with a trapezoidal transverse cross sectional shape. The complementary formed grooves 24 are provided with a similar trapezoidal cross sectional shape. The corner support members 26 are preferably integrally molded with the support plate 13 and may be secured to the support brace members 32 by transverse connecting pins 34. Conventional adhesive or thermosetting bonding techniques may be utilized to permanently connect the support members 32 with the corner support members 26. As described previously, the projecting ribs 22, or portions thereof may be formed from a thermo setting plastic material having a fusing point lower than the melting point of the remaining components of the individual construction unit 12. This allows a number of individually configured pallets to be quickly assembled and permanently bonded without the requirement of applying adhesives to the mating portions of each individual construction unit 12. Conventional thermo plastic materials may be employed, as well as conventional bonding furnaces.

Figure 4:
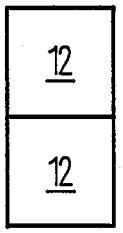
FIG. 4, FIG. 5, and FIG. 6 illustrate various configurations which may be formed by the assembly of individual construction units.
Figure 5:
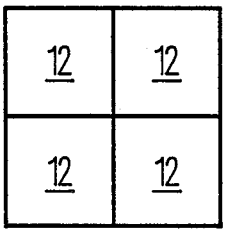
Figure 6:
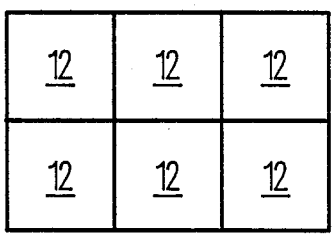

FIG. 4, FIG. 5, and FIG. 6 illustrate example pallet configurations which may be formed by the assembly of a plurality of individual construction units 12. It should be noted that the pallet shapes need not be square or rectangular, but may be any required irregular shape as well.

Figure 7:
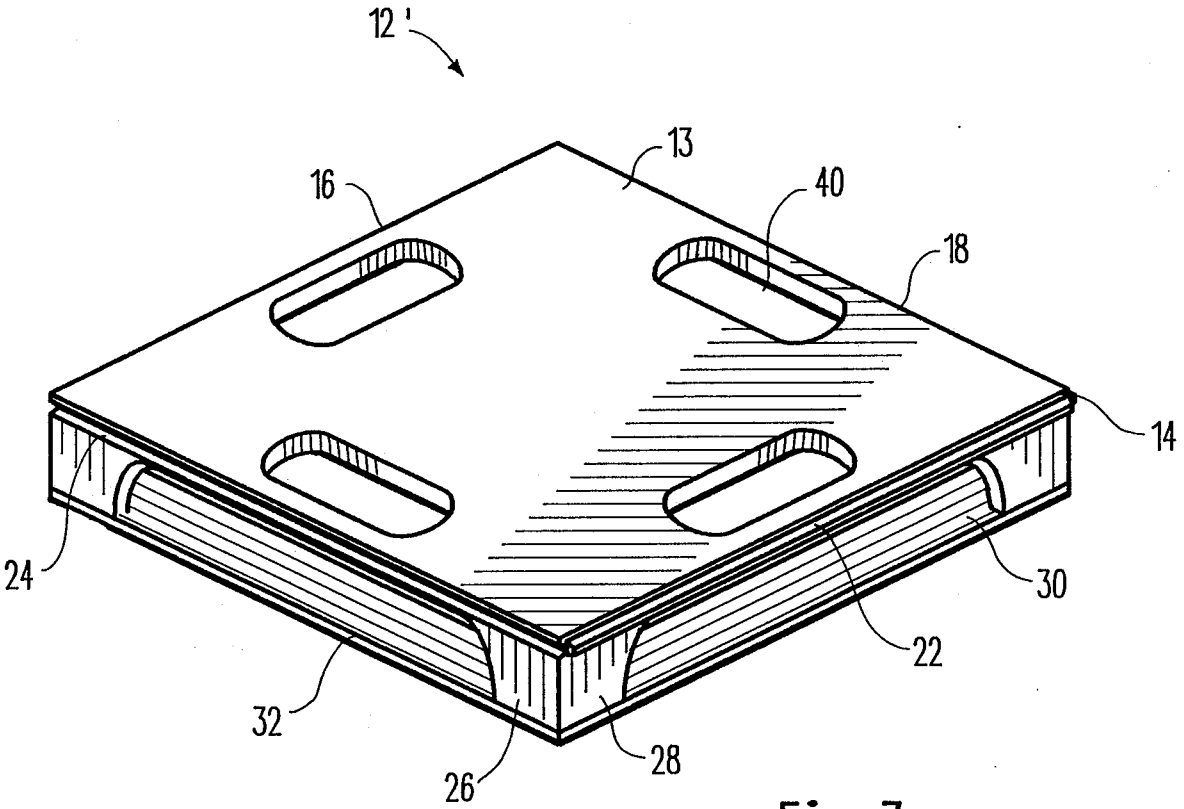
FIG. 7 is a perspective view illustrating an individual construction unit according to a slightly modified second embodiment of the present invention, which provides securement strap receiving apertures.

FIG. 7 is a illustrates a perspective view of a slightly modified individual construction unit 12', according to a second embodiment of the present invention. The construction unit 12' is identically formed as described previously with respect to the first embodiment 12 of the invention, with the exception that a plurality of securement strap receiving apertures 40 are provided centrallY along each of the side edges 14, 16, 18 and 20. This allows conventional banding techniques to be utilized to secure loads on the pallet. The support brace members 30 and 32 may be separately formed and secured adhesively through the use of miter cornered joints and reinforcing pins, or the support brace members 30 and 32 may be formed as an integral unit by cutting a rectangular frame from a flat piece of stock material. While the individual construction units 12 and 12' are preferably formed from a plastic material, alternative construction materials such as wood, cardboard, and sheet metal may be employed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A freight pallet formed from at least two interlocking construction units, each of said units comprising:
- a square thin support plate;
- a projecting rib extending along each of a first two adjacent perpendicular side edges of said plate;
- a complementary formed groove extending along each of a second two adjacent perpendicular side edges of said plate;
- a right angle corner support member perpendicularly attached at each corner on a bottom surface of said support plate;
- a support brace member extending between each adjacent pair of said corner support members; and
- said units formed from a plastic material and said projecting ribs and grooves at least partially formed from a thermoplastic material having a lower fusing point than the rest of said unit.

2. The interlocking freight pallet of claim 1, wherein each of said projecting ribs and complementary recesses have a trapezoidal cross sectional shape.

3. The interlocking freight pallet of claim 1, further comprising at least one securement strap receiving aperture formed through said support plate.

4. A construction unit for forming freight pallets, comprising:
- a square thin support plate;
- a projecting rib extending along each of a first two adjacent perpendicular side edges of said plate;
- a complementary formed groove extending along each of a second two adjacent perpendicular side edges of said plate;
- a right angle corner support member perpendicularly attached at each corner on a bottom surface of said support plate;
- a support brace member extending between each adjacent pair of said corner support members; and
- said unit formed from a plastic material and said projecting ribs and grooves at least partially formed from a thermoplastic material having a lower fusing point than the rest of said unit.

5. The construction unit of claim 4, wherein each of said projecting ribs and complementary recesses have a trapezoidal cross sectional shape.

6. The construction unit of claim 4, further comprising at least one securement strap receiving aperture formed through said support plate.

7. A method of forming a freight pallet having a user determined configuration, comprising the steps of:
- (a) providing a plurality of construction units formed from a plastic material, each of said units including:
  - a square thin support plate;
  - a projecting rib extending along each of a first two adjacent perpendicular side edges of said plate;
  - a complementary formed groove extending along each of a second two adjacent perpendicular side edges of said plate;
  - thermoplastic materials on at least a portion of said projecting ribs and said complementary grooves, said thermoplastic materials having a lower fusing point than the rest of the unit;

a right angle corner support member perpendicularly attached to each corner on a bottom surface of said support plate;

a support brace member extending between each adjacent pair of said corner support members;

(b) arranging said construction units in a desired assembled configuration;

(c) engaging the projecting ribs and complementary grooves of mating side edges of adjacent units; and (d) heating said assembled configuration of units sufficiently to bond said ribs in said grooves.

* * * * *